US009779662B1

(12) United States Patent
Zhang et al.

(10) Patent No.: US 9,779,662 B1
(45) Date of Patent: Oct. 3, 2017

(54) PIXEL CIRCUIT AND DRIVE METHOD THEREFOR, AND DISPLAY DEVICE

(71) Applicant: PEKING UNIVERSITY SHENZHEN GRADUATE SCHOOL, Shenzhen (CN)

(72) Inventors: Shengdong Zhang, Shenzhen (CN); Cuicui Wang, Shenzhen (CN); Chuanli Leng, Shenzhen (CN); Longyan Wang, Shenzhen (CN)

(73) Assignee: Peking University Shenzhen Graduate School, Shenzhen, Guangdong (CN)

( * ) Notice: Subject to any disclaimer, the term of this patent is extended or adjusted under 35 U.S.C. 154(b) by 0 days.

(21) Appl. No.: 15/310,086

(22) PCT Filed: Nov. 7, 2014

(86) PCT No.: PCT/CN2014/090567
§ 371 (c)(1),
(2) Date: Nov. 9, 2016

(87) PCT Pub. No.: WO2015/180419
PCT Pub. Date: Dec. 3, 2015

(30) Foreign Application Priority Data

May 27, 2014 (CN) ..... 2014 1 0227916

(51) Int. Cl.
*G09G 3/3233* (2016.01)

(52) U.S. Cl.
CPC ..... *G09G 3/3233* (2013.01); *G09G 2300/043* (2013.01); *G09G 2300/0439* (2013.01); *G09G 2310/08* (2013.01)

(58) Field of Classification Search
CPC ..... G09G 3/30–3/3291; G09G 2300/0439
See application file for complete search history.

(56) References Cited

U.S. PATENT DOCUMENTS 9,299,290 B2 * 3/2016 Ono ..... G09G 3/3258
2006/0077134 A1 * 4/2006 Hector ..... G09G 3/3233 345/76

(Continued)

FOREIGN PATENT DOCUMENTS

CN 101075407 A 11/2007
CN 101256737 A 9/2008

(Continued)

OTHER PUBLICATIONS

PCT International Preliminary Report on Patentability Chapter I (with Written Opinion) from PCT/CN2014/090567 dated Nov. 29, 2016, and its English translation from WIPO.

(Continued)

*Primary Examiner* — Patrick F Marinelli
(74) *Attorney, Agent, or Firm* — Ladas & Parry, LLP

(57) ABSTRACT

A pixel circuit, a drive method based on the pixel circuit, and a display device. The pixel circuit comprises: a first capacitor (C1), a second capacitor (C2), a second transistor (T2), a third transistor (T3) and a light-emitting branch for being coupled between a first common electrode (VDD) and a second common electrode (VSS); wherein the light-emitting branch comprises a first transistor (T1), a fourth transistor (T4) and a light-emitting element (OLED) which are connected in series; a first electrode of the first transistor (T1) is coupled to a second electrode of the fourth transistor (T4), and a coupling node is a third node (C); and a control electrode of the fourth transistor (T4) is used for inputting a second scanning control signal ($V_{EM}$), and the fourth transistor (T4) switches the ON/OFF state of the light-emitting branch in response to the second scanning control signal ($V_{EM}$). At the programming stage, a threshold voltage of the first transistor (T1) is input to a first node (A) through the third transistor (T3) and is stored; and at the light-emitting stage, a light-emitting current for driving the light-emitting (Continued)

element (OLED) is generated according to information about a voltage difference across two ends of the first capacitor (C1). The pixel circuit is used for compensating for the threshold voltage shift of the first transistor (T1) and the light-emitting element (OLED).

11 Claims, 6 Drawing Sheets

(56) References Cited

U.S. PATENT DOCUMENTS

| | | | | |
|---|---|---|---|---|
| 2009/0219232 | A1 | 9/2009 | Choi | |
| 2012/0120042 | A1* | 5/2012 | Tsai | G09G 3/3233 345/211 |
| 2013/0127812 | A1* | 5/2013 | Abe | G09G 3/2014 345/211 |
| 2013/0249875 | A1* | 9/2013 | Tseng | G09G 3/3233 345/205 |
| 2013/0249883 | A1* | 9/2013 | Hwang | G09G 3/003 345/212 |
| 2013/0300724 | A1* | 11/2013 | Chaji | G09G 3/3233 345/212 |
| 2014/0055327 | A1* | 2/2014 | Kim | G09G 3/3233 345/77 |
| 2014/0168195 | A1* | 6/2014 | Kumeta | G09G 3/3233 345/212 |
| 2014/0313106 | A1* | 10/2014 | In | G09G 3/3233 345/76 |
| 2014/0362130 | A1* | 12/2014 | Duan | G09G 3/3225 345/690 |
| 2015/0035448 | A1* | 2/2015 | Wang | G09G 3/3291 315/240 |
| 2015/0221251 | A1* | 8/2015 | Wang | G09G 3/3233 345/690 |
| 2015/0310806 | A1* | 10/2015 | Hu | G09G 3/3258 345/78 |
| 2015/0325171 | A1* | 11/2015 | Zhou | G09G 3/3233 345/80 |
| 2015/0356919 | A1* | 12/2015 | Wang | G09G 3/3266 345/690 |
| 2016/0063923 | A1* | 3/2016 | Yang | G09G 3/3258 345/211 |
| 2016/0275868 | A1* | 9/2016 | Fujita | G09G 3/3233 |
| 2016/0322450 | A1* | 11/2016 | Lee | H01L 27/3276 |
| 2017/0047010 | A1* | 2/2017 | Chen | G09G 3/3258 |

FOREIGN PATENT DOCUMENTS

| | | | |
|---|---|---|---|
| CN | 102163402 | A | 8/2011 |
| CN | 203376957 | U | 1/2014 |

OTHER PUBLICATIONS

PCT International Written Opinion from PCT/CN2014/090567 dated Feb. 6, 2015, and its English translation from WIPO.

International Search Report for PCT/CN2014/090567 dated Feb. 6, 2015 and its English translation provided by WIPO.

Written Opinion of the International Search Authority for PCT/CN2014/090567 dated Feb. 6, 2015 and its English translation provided by Bing Translator.

* cited by examiner

PIXEL CIRCUIT AND DRIVE METHOD THEREFOR, AND DISPLAY DEVICE

CROSS REFERENCE TO RELATED APPLICATIONS

The present application is the U.S. national phase of PCT Application No. PCT/CN2014/090567 filed on Nov. 7, 2014, which claims priority to Chinese Patent Application No. 201410227916.0 filed on May 27, 2014 and entitled "PIXEL CIRCUIT AND DRIVE METHOD THEREFOR, AND DISPLAY DEVICE", the disclosures of which are incorporated herein by reference in their entireties.

TECHNICAL FIELD

The present disclosure relates to the field of display device, and more particularly, to a pixel circuit and a driving method and a display apparatus.

BACKGROUND

In recent years, organic emitting diode (OLED) display has been widely studied and used as new generation display. This is because OLED display has many advantages, such as high brightness, high luminous efficiency, wide viewing angle and low power consumption. There are two kinds of driving method of OLED display, namely passive matrix OLED (PMOLED) and active matrix OLED (AMOLED).

Although PMOLED has the merit of low cost, there is cross talk phenomenon which hinders the implementation of high resolution display using PMOLED. And due to large driving current, the lifetime of PMOLED is decreased.

In contrast, for AMOLED, there are different numbers of transistors acting as current source in each pixel. Thus crosstalk can be avoided, and the driving current of OLED is small. Consequently, not only the power consumption is low, but also the lifetime of OLED can be extended, and high resolution display can be achieved. Meanwhile, it is easier to obtain large area display with high gray level by using AMOLED technology.

The conventional AMOLED pixel circuit consists of two thin film transistors (TFTs) and one storage capacitor. As shown in FIG. 1, the pixel circuit includes a driving TFT12, a switching TFT11, a storage capacitor 13 and an emitting device OLED14. The signal of the scan signal line can control the switching TFT12. Data signals of the data signal line 16 are sampling and supplied to gate electrode of the driving TFT11. The driving TFT11 generates the current needed by the OLED14 corresponding to the required gray scale. And the gray scale information is stored in a storage capacitor 13, and the storage capacitor 13 maintains the sampled data until the next frame.

$$I_{OLED} = \frac{1}{2}\mu_n C_{ox}\frac{W}{L}(V_G - V_{OLED} - V_{TH})^2$$

where $\mu_n$, $C_{ox}$, W/L are the field-effect mobility and gate capacitance per unit area and width/length ratio of the driving TFT11, respectively. And $V_G$ represents the voltage of the gate of the driving TFT11. And $V_{OLED}$ represents the voltage of the anodic of the OLED14 in emitting. And $V_{TH}$ represents the threshold voltage of the driving TFT11. Although the circuit structure is simple, the threshold voltage shift of the driving TFT11 and the degradation of OLED14 lead to the increase of $V_{OLED}$ over time. In the case of poly-silicon TFTs, due to the non-uniformity of threshold voltage of the driving TFT11 in the panel, the current of OLED14 changes with time or location, which leads to the uniformity issue in the display.

At present, there are two types of compensation method within pixel array, namely current mode and voltage mode. Although the current mode pixel circuit allows an accurate compensation, a long settling time is needed, especially in the case of small programming current and large parasitic capacitance on the data line. This severely limits the application of the current mode pixel circuit in a large area display with high resolution. Compensation accuracy of the voltage mode pixel circuit is worse than that of the current mode pixel circuit, and structure or/and drive signals of the voltage mode pixel circuit are relatively complicated. But the driving speed of the voltage mode pixel circuit is fast.

Nowadays, for most of the voltage type pixel circuits, threshold voltage is extracted using the topology of diode-charging or discharging, as shown in FIG. 2. In this scheme, a reasonable programming time is required to accurately extract the threshold voltage of the driving TFT21. On one hand, if the programming time is too short, the discharging of storage capacitor 22 will not be completed, thus the extracted threshold voltage (voltage of node 23) is higher than the actual value. On the other hand, after the extraction of the threshold voltage of the driving TFT21 is completed, the drive transistor begins to enter the sub-threshold region, and if the programming time is too long, the storage capacitor 22 will continue to discharge through the driving TFT21, resulting in the extracted threshold voltage to be less than the actual value. In the practical application, when the threshold voltage of both the driving TFT and the emitting device OLED14 is degraded, it is difficult to accurately determine the programming time.

SUMMARY

This disclosure provides a pixel circuit and a driving method thereof and a display apparatus, which is capable of compensating for the threshold voltage shift of the first transistor.

According to one aspect of the disclosure, an implementation mode provides a pixel circuit, comprising:

a first capacitor, a second capacitor, a second transistor, a third transistor, and a emitting branch between the first common electrode and the second common electrode. Among them, the emitting branch comprises a first transistor, a fourth transistor and an emitting element in series; the first electrode of the first transistor is coupled to the second electrode of the fourth transistor, and the coupled node is the third node; the control electrode of the fourth transistor is used to receive the second scan control signal, the fourth transistor is controlled by the second scan control signal, and it is used to switch the emitting branch;

the first terminal of the first capacitor is a second node, which is coupled the data signal line and inputting the data signal; the second terminal of the first capacitor is coupled to the control electrode of the first transistor to form the first node;

one terminal of the second capacitor is coupled to the third node, and the other terminal is coupled to the second common electrode;

the control electrode of the second transistor is used to receive the first scan control signal, the first electrode is coupled to the control electrode of the third transistor, the second electrode is coupled to the third electrode;

the first electrode of the third transistor is used to receive the third control signal, the second electrode is coupled to the first node;

in the programming phase, the fourth transistor is turned off corresponding to the second scan control signal; the second transistor is turn on corresponding to the first scan control signal; the third control signal charge to the first node through the third transistor, the data signal and the threshold voltage of the first transistor are stored in the first capacitor;

in the emitting phase, the second transistor and the third transistor are turned off corresponding to the first scan control signal; the fourth transistor is turned on corresponding to the second scan control signal, and the voltage of the first node controls the first transistor to provide a driving current to the emitting element.

According to the second aspect of the disclosure, a display device is provided in a implementation mode, comprising:

pixel circuit matrix, pixel circuit matrix including the above pixel circuits arranged in rows of M and columns of N, N and M are the integer of greater than 0;

the gate driving circuit is used for generating the scanning pulse signal, and supplying first scan control signal for pixel arrays in the first direction; the gate driving circuit is also used for providing the second and third scan control signal for pixel arrays in the first direction;

the data driving circuit is used for generating the data voltage signal which contains the gray level information, and providing data signals to the pixel circuit in the second direction;

the controller is used to provide a control timing. to a gate driver circuit and a data driving circuit.

According to the third aspect of the disclosure, an implementation mode provides a pixel circuit driving method, each driving cycle includes: initialization phase, programming phase and emitting phase;

in the initialization phase, the second transistor, the third transistor and the fourth transistor are turned on to initialize the voltage of both each terminals of the first and second capacitor;

in the programming phase, the second and third transistor are turned on. The threshold voltage of the first transistor or the threshold voltage of the first transistor and the emitting element is transferred to the first node through the second and third transistor; and the threshold voltage is stored at the first node by the first capacitor; and the data signal is stored in the second node also through the first capacitor;

in the emitting phase, driving current is provided by the first transistor in accordance to the voltage difference of the terminals of the first capacitor; and the emitting element is driven by the first transistor to emit light.

In the proposed pixel circuit in the disclosure, the non-diode connection topology is adopted. The second transistor and the third transistor are coupled between the first electrode and the control electrode of the first transistor. This specific structure, in cooperation with the first and second capacitor, is used for threshold voltage extraction of the first transistor. In the programming stage, the threshold voltage of the first transistor is extracted and stored in the first capacitor. After completion of the pixel circuit programming of this scan line, the extraction threshold voltage is not affected by continuous following long programming time. Thus both the speed and accuracy of the threshold voltage extraction process can be well obtained. The pixel circuit can compensate for the threshold voltage shift of the first transistor

DETAILED DESCRIPTION

The implementations of the present disclosure are further described below in detail with reference to the accompanying drawings.

First, some terms are explained. The transistor in this disclosure may be with different structure, for example, bipolar junction transistor (BJT) or field effect transistor (FET). When the transistor is a bipolar junction transistor, the control electrode is refers to the base electrode of the bipolar transistor, and the first electrode can be a collector electrode of a bipolar transistor, and the second electrode can be a emitter electrode of a bipolar transistor. When the transistor is a field effect transistor, the control electrode is the gate electrode of the field effect transistor, and the first electrode can be a drain or source electrode of a field effect transistor, and the second electrode can be a source or drain electrode of a field effect transistor. A transistor in display is usually thin film transistor (TFT). In the following, the field effect transistor is taken as an example to make a detailed description of the disclosure. And in other embodiments, the transistor may also be a bipolar junction transistor.

Emitting element is referred to organic emitting diodes (organic emitting diode OLED), and the emitting element can also be other types of emitting elements in other embodiments. For organic emitting diode, the first terminal of the emitting element is anode, and the second terminal of emitting element is the cathode.

It needs to be explained that the first common electrode VDD and the second common electrode VSS are not the part of the pixel circuit for this disclosure. For a better understanding of the technical scheme of the disclosure, in particular, the first common electrode VDD and second common electrode VSS are described.

It needs to be explained that, for the convenience of description, and for a better understanding of the technical scheme of the disclosure, the first node A, the second node B and the third node C are introduced in the disclosure document for identification of associate nodes in the circuit structure, and they can't be considered as additional terminals in the circuit.

First Embodiment

Figure 1:
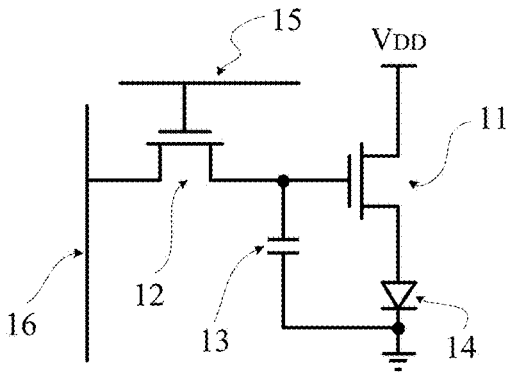
FIG. 1 is a schematic diagram of the conventional 2T1C pixel circuit.
Figure 2:
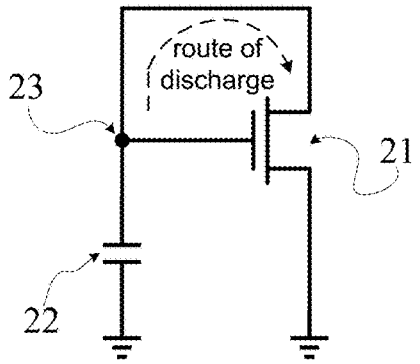
FIG. 2 is a schematic diagram of the threshold voltage extraction of the pixel circuit using diode topology.
Figure 3:
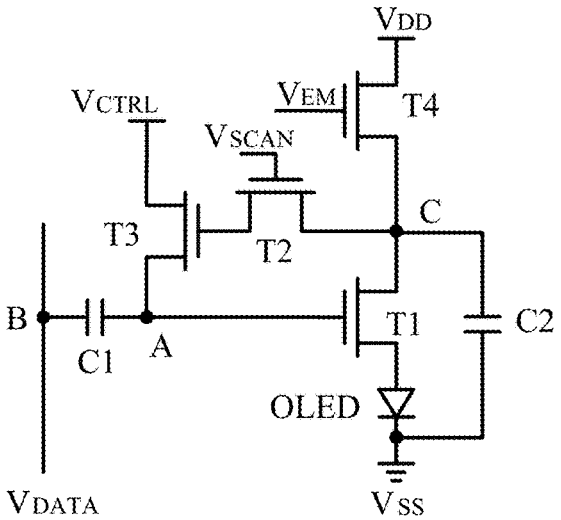
FIG. 3 is a structure diagram of a pixel circuit in a first embodiment of the disclosure.

FIG. 3 shows the structure of an embodiment of this disclosure pixel circuit, including:

the first capacitor C1, the second capacitor C2, the second transistor T2, the third transistor T3, and the emitting branch for coupling between the first common electrode VDD and the second common electrode VSS. The emitting branch comprises a first transistor, a fourth transistor and a emitting element in series.

Among them, the first electrode of the first transistor T1 is coupled to the second electrode of the fourth T4 transistor, and the coupled node is the third node C. The control electrode of the fourth transistor is used to receive the second scan control signal $V_{EM}$, the fourth transistor T4 is used to switch the emitting branch corresponding to the second scan control signal $V_{EM}$.

The first terminal of the first capacitor C1 is a second node B, which is coupled to the data signal line and receiving the data signal $V_{DATA}$; the second terminal of the first capacitor C1 is coupled to the control electrode of the first transistor T1 to form the first node A.

One terminal of the second capacitor C2 is coupled to the third node C, and the other terminal is coupled to the second common electrode VSS.

The control electrode of the second transistor T2 is used to receive the first scan control signal $V_{SCAN}$, the first electrode is coupled to the control electrode of the third transistor T3, the second electrode is coupled to the third electrode C.

The first electrode of the third transistor T3 is used to receive the third control signal $V_{CTRL}$, the second electrode is coupled to the first node A.

According to an embodiment, emitting OLED can be connected in series between the second common electrode VSS and the first transistor T1, as shown in FIG. 3. The first electrode of the fourth transistor T4 is coupled to the first common electrode VDD. The first terminal of emitting element OLED is coupled to the second electrode of the first transistor T1. The second terminal of emitting element OLED is coupled to the second common electrode VSS.

Figure 4:
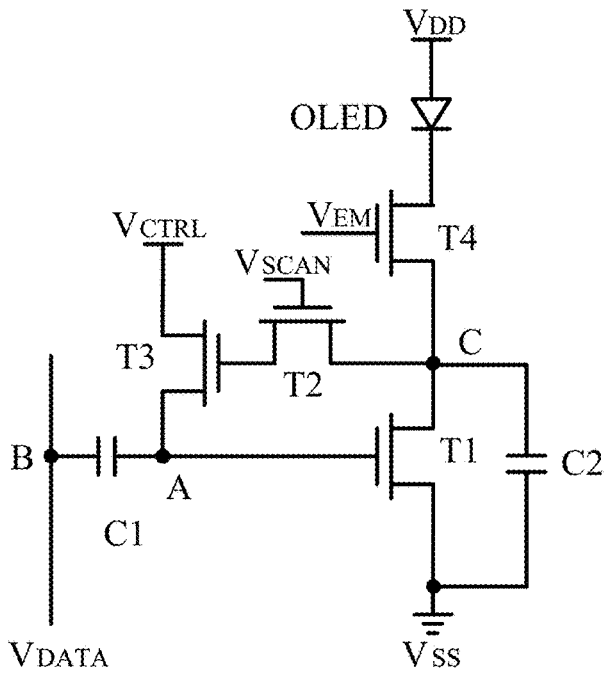
FIG. 4 is a structure diagram of another pixel circuit in a first embodiment of the disclosure.

According to another embodiment, emitting OLED can also be connected in series between the first common electrode VDD and the fourth transistor T4, as shown in FIG. 4. The first electrode of the fourth transistor T4 is coupled to the second terminal of emitting element OLED, and the first terminal of OLED is coupled to the first common electrode VDD; and the second electrode of the first transistor T1 is coupled to the second common electrode VSS.

Figure 5:
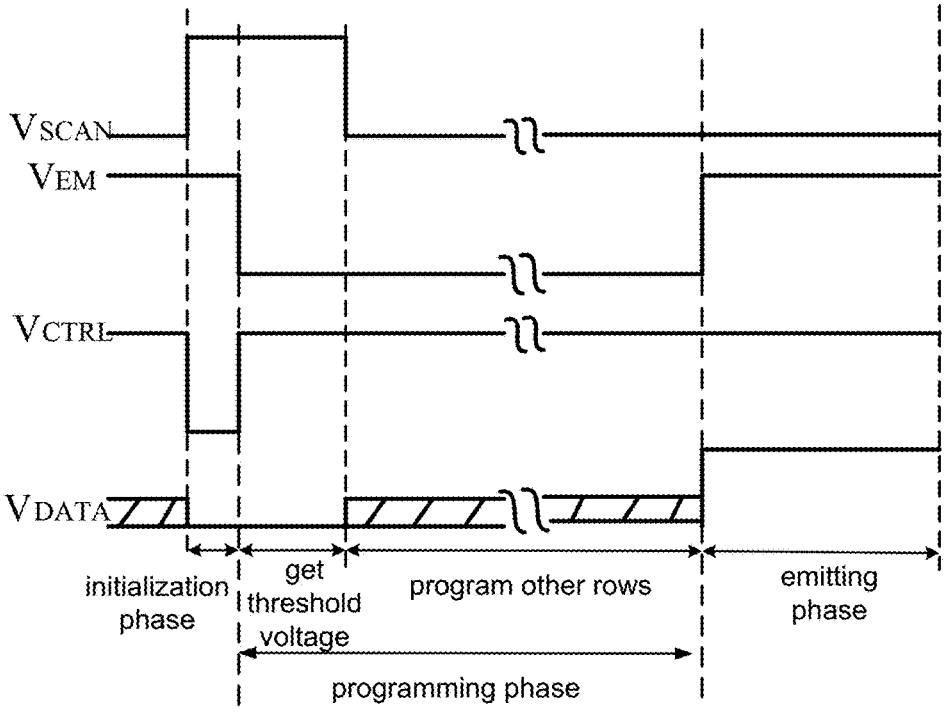
FIG. 5 is an operation timing diagram of pixel circuit in a first embodiment of the disclosure.

In the present embodiment, emitting OLED is connected in series between the second common electrode VSS and the first transistor T1 as an example to illustrate, and all transistors are N channel type transistor as an example to describe the operating process of the present embodiment. Driving process of pixel circuit is divided into initialization phase, the programming phase and the emitting phase, the signal timing for the present embodiment is shown in FIG. 5. In the following, emitting OLED is connected in series between the second common electrode VSS and the first transistor T1, and this case is taken as an example, combined with FIG. 3 and FIG. 5 for description of the driving process of the present embodiment.

In the initialization phase, when the present pixel row line is selected, the first scan control signal $V_{SCAN}$ and the second scan control signal $V_{EM}$ outputs a high voltage, the third control signal $V_{CTRL}$ outputs a low voltage. At this time, the second transistor T2 and the fourth transistor T4 are turned on correspondingly to the first scan control signal $V_{SCAN}$ and a second scan control signal $V_{EML}$ respectively. Thus, the second capacitor C2 is charged to the high voltage, that is, the third node C is high voltage, In other words, the control electrode of the third transistor T3 is high voltage. And the third control signal $V_{CTRL}$ is low voltage, the charge stored in the first capacitor C1 is discharged through the third transistor T3. Thus, the potential of the first node A is discharged to a low level, and the low level may be a zero level, or a negative level. At this time, the first transistor T1 is turned off, and the data signal $V_{DATA}$ is transferred to the second node B.

During the programming phase, the second scan control signal $V_{EM}$ is switched from a high level to a low level, so the fourth transistor T4 is turned off. The first scan control signal $V_{SCAN}$ is still high level, so the second transistor T2 is maintained on. The third control signal $V_{CTRL}$ is high level, at this time the third node C is high voltage, the first node A is low voltage, and thus the first capacitor C1 is charged with fast speed due to the large current provided by the third transistor T3. When the voltage of the first node A is equal to the sum of T1's threshold voltage and OLED's threshold voltage emitting OLED, the first transistor T1 will be turned on. And the second capacitor C2 begins to discharge. When the voltage difference between the third node C and the first node A is equal to the threshold voltage of the third transistor T3, the third control signal $V_{CTRL}$ stop to charge the first node A. Thus the threshold voltage of the first transistor T1 and emitting OLED can be extracted. Since the first transistor T1 is still turned on, the third node C will be quickly discharged to the threshold voltage of emitting OLED, thus the third transistor T3 will be completely turned off, and the voltage of first node A will not be affected by the programming time. And the potential of the second node B is the data signal $V_{DATA}$, the two terminals of the first capacitor C1 form a reference voltage that can be maintained within a whole frame time. At this time, the voltage difference between the first node A and the second node B is:

$$V_A - V_B = V_{TH_T1} + V_{OLED0} - V_{DATA} \quad (1)$$

Among them, $V_A$ is the potential of the first node A, $V_B$ is the potential of the second node B, $V_{TH_T1}$ represents the threshold voltage of the first transistor T1, $V_{OLED0}$ represents the threshold voltage of emitting OLED, $V_{DATA}$ represents the corresponding data signal voltage of the gray level information needed by the pixel at the time.

When the first scan control signal $V_{SCAN}$ is switched from the high level to the low level, the programming process of the present row is completed. After a preset time, if data is written to all rows, a stable reference voltage $V_{REF}$ will be provided to the data line, then the emitting phase starts. It needs to be explained that, the circuit can enter into the emitting phase immediately after the programming is completed, as shown in FIG. 3. However, for the polarity of rows pixel circuits, all rows need to be programmed with the specific data before entering the emitting phase.

In the emitting phase, the first scan control signal $V_{SCAN}$ is low level; the second scan control signal $V_{EM}$ is high level. Thus, the second transistor T2 is turned off corresponding to the first scan control signal $V_{SCAN}$, the fourth transistor T4 is turned on corresponding to the second scan control signal $V_{EM}$. And the power voltage can be provided to the first transistor T1, thus emitting element OLED can be driven to emit. In the programming process, the reference voltage is formed at the two terminals of the first capacitor C1. And due to the bootstrapping effect of C1, the reference voltage can be added to the first node A. So, the voltage of the first node A is:

$$V_A = V_{TH_T1} + V_{OLED0} - V_{DATA} + V_B \quad (2)$$

Since the data line supplies a stable reference voltage $V_{REF}$ in the emitting phase, the second node B potential $V_B = V_{REF}$. Thus formula (2) can be converted to:

$$V_A = V_{TH_T1} + V_{OLED0} - V_{DATA} + V_{REF} \quad (3)$$

Fourth transistor T4 is turned on and supplying a power voltage to the first transistor T1, as a result, the first transistor T1 operate in the saturation region. So the current produced by the first transistor T1, that is, the emitting current flowed through emitting OLED can be expressed as:

$$\begin{aligned} I_{OLED} &= \frac{1}{2}\mu_n C_{OX}\frac{W}{L}(V_{TH_T1} + V_{OLED0} - V_{DATA} + V_{REF} - \\ &\quad V_{TH_T1} - V_{OLED1})^2 \\ &= \frac{1}{2}\mu_n C_{OX}\frac{W}{L}(V_{OLED0} - V_{DATA} + V_{REF} - V_{OLED1})^2 \end{aligned} \quad (4)$$

where $I_{OLED}$ is a emitting current flowed through emitting OLED; $\mu_n$, $C_{OX}$ and W/L are the field effect mobility of the first transistor T1, the gate insulating layer capacitance per unit area and the ratio of width to length of transistor, respectively. $V_{OLED1}$ represents the voltage at both terminals of the OLED, $V_{OLED1} = V_{OLED0} + \Delta V$, Where the $\Delta V$ based on $V_{DATA}$, $V_{REF}$ and $I_{OLED}$ is the amount of prior calibration in the design process, and the $\Delta V$ is a constant. When emitting OLED is degraded, $V_{OLED0}$ will be increased. Thus from the formula (4) can obtain:

$$\begin{aligned} I_{OLED} &= \frac{1}{2}\mu_n C_{OX}\frac{W}{L}(V_{OLED0} - V_{DATA} + V_{REF} - \\ &\quad (V_{OLED0} + \Delta V))^2 \\ &= \frac{1}{2}\mu_n C_{OX}\frac{W}{L}(V_{DATA} + V_{REF} - \Delta V)^2 \end{aligned} \quad (5)$$

Formula (5) showed that the current $I_{OLED}$ flowing through emitting OLED is independent of the threshold voltage $V_{TH_T1}$ of first transistor and the threshold voltage $V_{OLED0}$ of light-emitting element OLED, only is dependent of data signal Vdata related the present pixel gray and the $\Delta V$ has been designed and the known reference voltage $V_{REF}$.

The pixel circuit in the present embodiment of the embodiment not only can compensate the threshold voltage shift of the driving transistor and the emitting element, but also can compensate the display non-uniform problem caused by the mismatch of the threshold voltage of the driving transistor of the pixel circuit of panel. And the pixel circuit adopts a non-diode-connected topology to extract the threshold voltage of the voltage type pixel circuit. High speed and high accuracy can be achieved at the same time, and the accuracy is not affected by the programming time. And the light-emitting element does not emit light in the non-emitting cycle, which benefits increasing of the contrast ratio, and reduction of the degradation of the light-emitting element, and enhancing of the uniformity of the display.

In another specific embodiment, when emitting OLED is connected in series between the first common electrode VDD and the fourth transistor T4, as shown in FIG. 4. In the programming phase, only the threshold voltage of the first transistor T1 needs to be extracted. When voltage of the first node A is equal to the threshold voltage of the first transistor T1, T1 can be turned on, and the second capacitor C2 begin to discharge. When the voltage difference between the third node C and the first node A is equal to the threshold voltage of the third transistor (T3), $V_{CTRL}$ stop to charge the node A. Thus the threshold voltage of the first transistor T1 extraction is completed. Different with the above embodiment, the first terminal of emitting OLED is coupled to the first common electrode VDD, and the second terminal of emitting OLED is coupled to the first electrode of the fourth transistor T4. In this case, the gate-source voltage of the first transistor T1 will not be affected by the degradation of OLEDOLED. The current flowing through OLED is independent of the voltage at OLED electrode. Therefore, for the pixel circuit, the threshold voltage shift of OLED does not need to be compensated. Thus only the threshold voltage shift of the first transistor T1 needs to be compensated. Due to the non-diode-connected topology for threshold voltage extraction in this pixel circuit, both high speed and high accuracy can be achieved. Once the threshold voltage extraction is completed, the duration of the program will not affect the threshold voltage extracted.

Second Embodiment

The circuit provided by first embodiment adopts a simultaneous-emitting-mode. For the display device, all rows pixel need to be programmed before entering the emitting phase. It is assumed that the number of rows of the pixel array is n (n is a positive integer), after pixels of the k-th lines complete programming (k≤n, k is a positive integer), there are still pixels of (K+1)-th to the n-th lines that are required to be programmed, before all pixels of the display panel entering the simultaneous emitting phase. However, due to the simultaneous emitting mode, the effective light emitting time of pixel array is short and the driving current is required to be large, which may accelerate the degradation of OLED.

Figure 6:
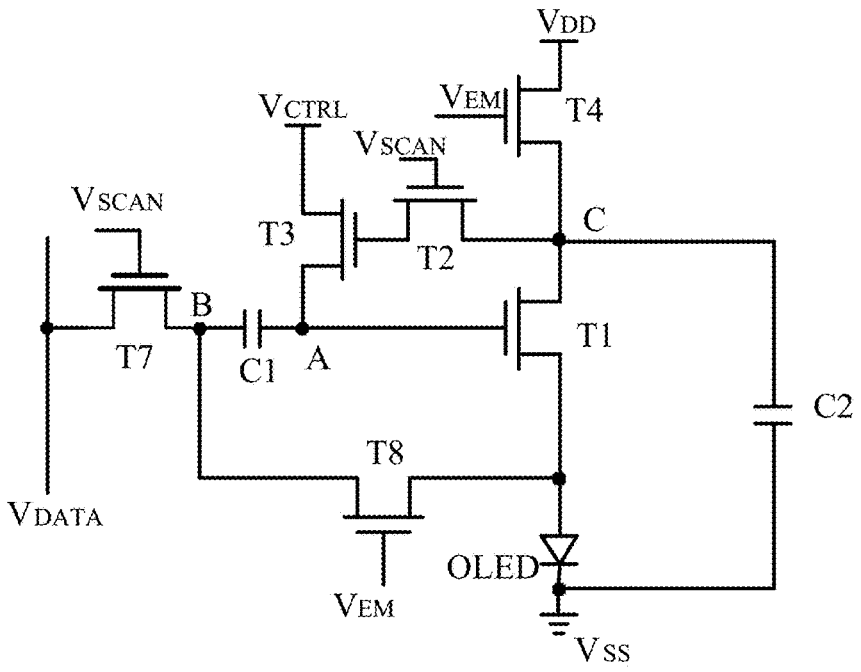
FIG. 6 is a structure diagram of a pixel circuit in a second embodiment of the disclosure.
Figure 7:
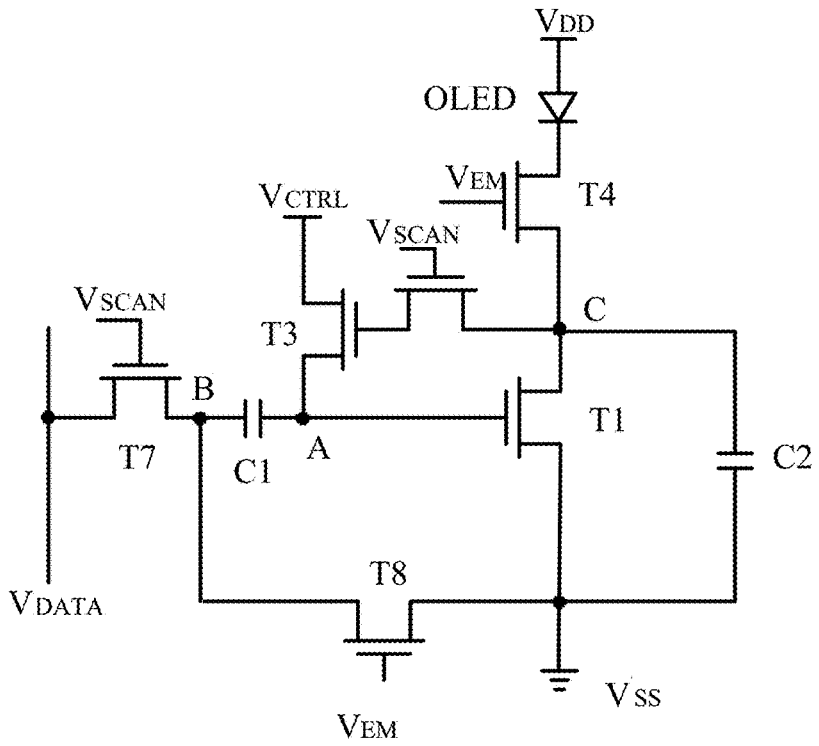
FIG. 7 is a structure diagram of another pixel circuit in a second embodiment of the disclosure.

To this end, the present embodiment discloses pixel circuit with a non-simultaneous-emitting-mode. FIG. 6 and FIG. 7 show the structure of the pixel circuit for the present embodiment. The difference between the present embodiment and the above embodiment is that, the seventh transistor T7 is coupled between the second node B and the data signal line, and the eighth transistor T8 is coupled between the first capacitor C1 and the first transistor T1. Where the first electrode of the seventh transistor T7 is coupled to the data signal line, the second electrode is coupled to the first terminal of the first capacitor C1, the control electrode is used to receive the first scan control signal $V_{SCAN}$; the first electrode of the eighth transistor T8 is coupled to the second electrode of the seventh transistor T7, the second electrode of eighth transistor T8 is coupled to the second electrode the first transistor T1, the control electrode of the eighth transistor T8 is used to receive the second scanning control signal $V_{EM}$.

Figure 8:
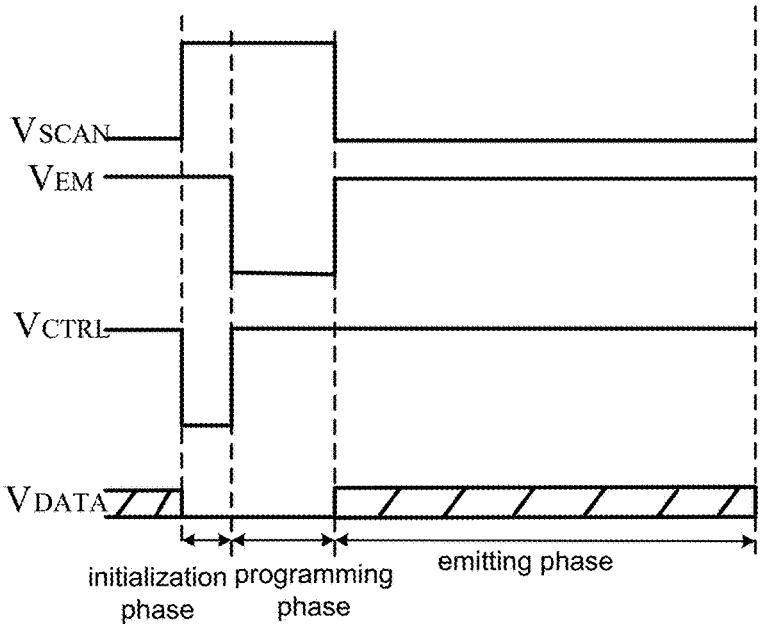
FIG. 8 is an operation timing diagram of pixel circuit in a second embodiment of the disclosure.

The case that OLED is connected in series between the second common electrode VSS and the first transistor T1 is taken as an example. FIG. 8 shows the signal timing of the present embodiment.

In the initialization phase, the first scan control signal $V_{SCAN}$ and the second scan control signal $V_{EM}$ are high level.

The seventh transistor T7 and the eighth transistor T8 are turned on corresponding to a high voltage of the first scan control signal $V_{SCAN}$ and a second scan control signal $V_{EM}$ respectively. Then during the initialization phase, the first capacitor C1 and the second capacitor C2 are initialized. In addition, the first scan control signal $V_{SCAN}$ is still high during the programming phase, thus the seventh transistor T7 is able to provide a data voltage $V_{DATA}$ to the first capacitor C1.

In the emitting phase, the second scan control signal $V_{EM}$ is high level, thus the eighth transistor T8 is turned on corresponding to the second scan control signal $V_{EM}$. Due to the bootstrapping effect of C1, voltage of OLED's first terminal OLED is added to the control electrode of the first transistor T1. Consequently, the non-uniform problem caused by the degradation of OLED's threshold voltage OLED can be compensated.

It needs to be explained that, in another specific embodiment, when OLED is connected in series between the first common electrode VDD and the fourth transistor T4, as shown in FIG. 7, although the threshold voltage shift caused by the degradation of OLED is not required to be compensated, the eighth transistor T8 is still needed to provide a constant voltage for the emitting phase.

It needs to be explained that the operating process of the circuit shown in FIG. 6 and FIG. 7 can also divided into three phases, namely the initialization phase, the programming phase and the emitting phase. Specific analysis can refer to first embodiment, here no longer.

Compared with first embodiment, although circuit structure of the present embodiment has increased the complexity, the second embodiment operates with progressive emitting mode, as shown in FIG. 8. After completion of the programming phase, the proposed pixel circuit enters the emitting phase. Thus, the luminous time is extended, and the driving current of OLED is relatively small, and the degradation rate of OLED can be decreased consequently. In addition, during the whole process of the programming, the degradation of OLED in the emitting can be reflected to the control electrode of the first transistor T1 with fast speed. As the degradation of OLED's emission efficiency can be compensated, the compensation effect can be improved. As shown in FIG. 6, the circuit operating procedure is as follows:

During the initialization phase, as the current pixel row is selected, the first scan control signal $V_{SCAN}$ and the second scan control signal $V_{EM}$ are all high level, and the third control signal $V_{SCAN}$ is low level. The second transistor T2, and the seventh transistor T7, and the fourth transistor T4 and the eighth transistor T8 are turned on corresponding to the first scan control signal $V_{SCAN}$ and a high level of second scan control signal $V_{EM}$ respectively. Thus, the second capacitor C2 is charged to the high level, and the third node C is high level. Here node C is the control terminal of the third transistor T3. At this time, the third control signal $V_{CTRL}$ is low, thus the charge stored in the first capacitor C1 is discharged through the third transistor T3, and the potential of the first node A is discharged to a low level, which may be a zero or negative potential. The first transistor T1 is in the off state, and the data signal $V_{DATA}$ of the data signal line is transferred to the second node B. Due to the eighth transistor T8 is turned on, the first terminal of OLED is charged with $V_{DATA}$. In order to turn off OLED for the initializing phase, it is required that $V_{DATA}<V_{OLED0}$.

During the programming phase, the second scan control signal $V_{EM}$ is switched from a high level to a low level; the fourth transistor T4 and the eighth transistor T8 are turned off. And the first scan control signal $V_{SCAN}$ is still high level, thus the second transistor T2 and the seventh transistor T7 are turned on corresponding to the first scan control signal $V_{SCAN}$. The third control signal $V_{CTRL}$ is high level. At this point, the third node C is high level, and the first node A is low level, so there is a large current flowing through the third transistor T3 to charge the first capacitor C1. When the potential of the first node A is equal to the sum of the threshold voltage of the first transistor T1 and the threshold voltage of OLED, the first transistor T1 is turned on and the second capacitor C2 begins to discharge. When the voltage difference between the third node C and the first node A is equal to the threshold voltage of the third transistor T3, the third control signal $V_{CTRL}$ stops to charge the first node A, thus the threshold voltage of the first transistor T1 and OLED can be extracted. Since the first transistor T1 is still turned on at this time, the third node C will be quickly discharged to the threshold voltage of OLED. Thus the third transistor T3 will be completely turned off, the programming time will not affect the first node A voltage. At this time, the potential of the second node B (the second electrode of the first capacitor C1) is the data signal $V_{DATA}$, and the two terminals of the first capacitor C1 form a reference voltage that can be maintained throughout a frame time. So, the voltage difference between the first node A and the second node B is:

$$V_A-V_B=V_{TH_T1}+V_{OLED0}-V_{DATA} \tag{6}$$

Where $V_A$ is the potential of the first node A, $V_B$ is the potential of the second node B, $V_{TH_T1}$ represents the threshold voltage of the first transistor T1, $V_{OLED0}$ represents the threshold voltage of OLED, $V_{DATA}$ indicates the corresponding data signal voltage of the gray level information needed by the pixel at the time.

In the emitting phase, the first scan control signal $V_{SCAN}$ is low level, and the second scan control signal $V_{EM}$ is high level. Thus, the second transistor T2 and the seventh transistor T7 are turned off corresponding to the first scan control signal $V_{SCAN}$. The fourth transistor T4 and eighth transistor T8 are turned on corresponding to the second scan control signal $V_{EM}$. The power supply voltage is provided to the first transistor T1 through the fourth transistor T4. And at the same time, the voltage of the OLED is coupled to the first electrode of the first capacitor C1 through the eighth transistor T8. In the programming process, the reference voltage which is formed at two terminals of the first capacitor C1 is coupled to the control electrode T1, Thus OLED is driven to emit light. So, the voltage of the first node A is:

$$V_A=V_{TH_T1}+V_{OLED0}-V_{DATA}+V_B \tag{7}$$

At this time, the potential of the second node B is $V_B=V_{OLED1}$, so that the formula (2) can be transformed into:

$$V_A=V_{TH_T1}+V_{OLED0}-V_{DATA}+V_{OLED1} \tag{8}$$

The power supply voltage is provided to the first transistor T1 through the fourth transistor T4. And the first transistor T1 is operated in the saturation region. So the current produced by the first transistor T1, that is, the emitting current flowed through OLED can be expressed as $$\begin{aligned} I_{OLED} &= \frac{1}{2}\mu_n C_{OX}\frac{W}{L}(V_{TH_T1}+V_{OLED0}-V_{DATA}+V_{OLED1}- \\ &\quad V_{TH_T1}-V_{OLED1})^2 \\ &= \frac{1}{2}\mu_n C_{OX}\frac{W}{L}(V_{OLED0}-V_{DATA})^2 \end{aligned} \tag{9}$$

Where $I_{OLED}$ is the emitting current flowed through OLED; $\mu_n$. $C_{OX}$ and W/L are the field effect mobility, the gate insulating layer capacitance per unit area and the ratio of width to length of the first transistor T1, respectively. When OLED is degraded, the voltage value of OLED will increase. Therefore, from the formula (9), it can be derived that the current flowed through the OLED will increased due to the increase of OLED's voltage. Thus the decrease of the luminous efficiency of OLED can compensated. It is also indicated that $I_{OLED}$ is independent of the threshold voltage $V_{TH_T1}$ of the first transistor T1.

The pixel circuit adopts a non-diode-connected topology to extract the threshold voltage. High speed and high accuracy can be achieved at the same time. Once the threshold voltage extraction is completed, the value of the extracted threshold voltage will not be affected by the programming time.

Third Embodiment

Figure 9:
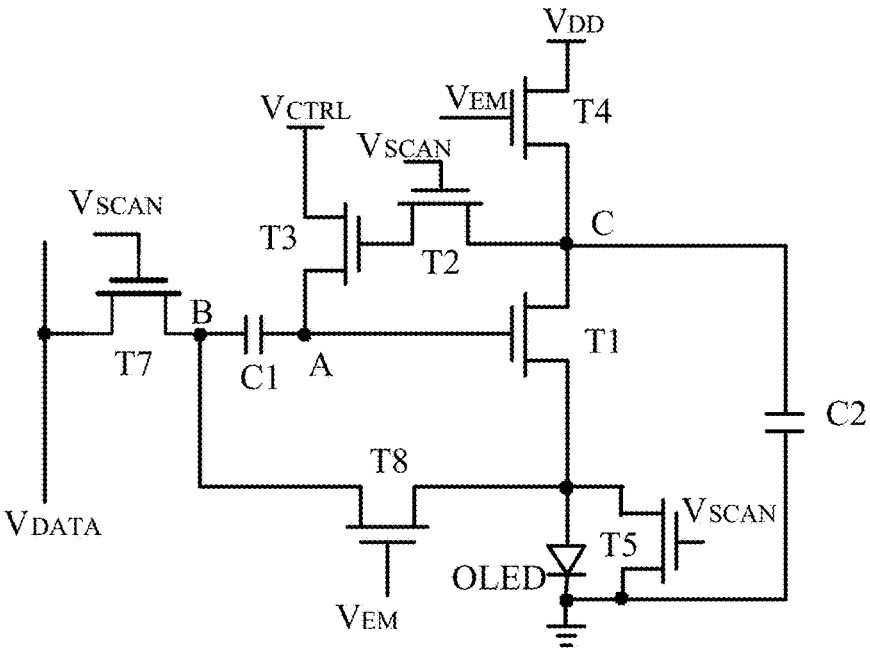
FIG. 9 is a structure diagram of a pixel circuit in a third embodiment of the disclosure.
Figure 10:
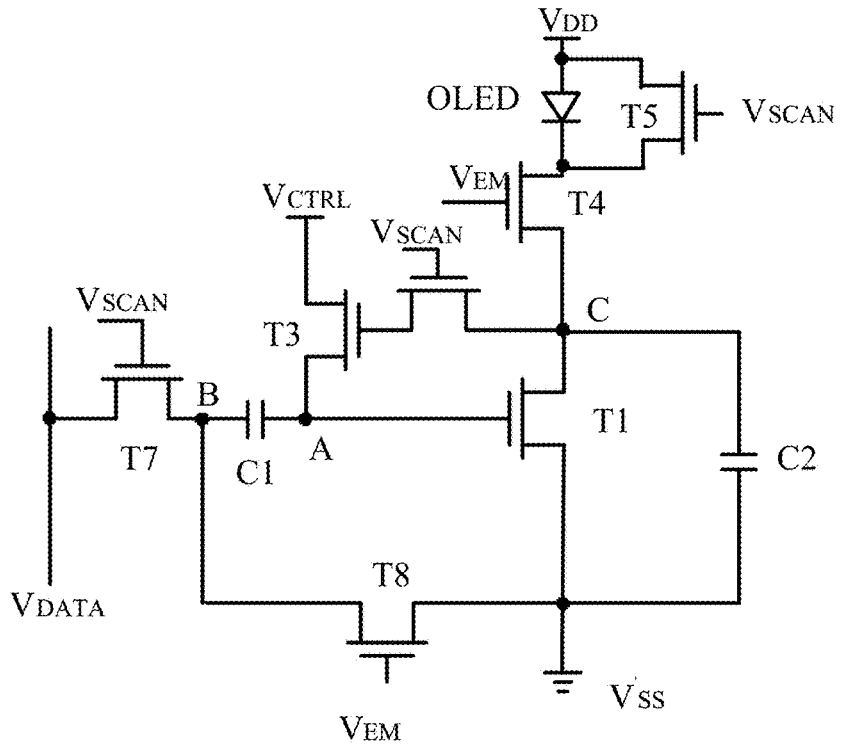
FIG. 10 is a structure diagram of another pixel circuit in a third embodiment of the disclosure.

FIG. 9 and FIG. 10 are the pixel circuit structure for the present embodiment. Different from above embodiment, the pixel circuit of the present embodiment also includes the fifth transistor T5, and the first electrode and second electrode of the fifth transistor T5 are connected in parallel with two terminals of OLED. And the control electrode of T5 is used to receive the first scan control signal $V_{SCAN}$.

When OLED is non-emitting, the fifth transistor T5 is turned on. And when OLED is emitting, the fifth transistor T5 is turned off. During the initialization phase and the programming phase, the fifth transistor T5 is turned on corresponding to the high level of the first scan control signal $V_{SCAN}$. In the emitting phase, the fifth transistor T5 is turned off corresponding to a low level of the first scan control signal $V_{SCAN}$. For the non-emitting phase, namely the initialization phase and the programming phase, as the fifth transistor T5 is turned on, the first terminal of OLED is connected to the second terminal through T5. Therefore, there are no additional current flows through OLED. Thus the contrast rate of the display can be increased, and the current flowed through the OLED is only depended on the data voltage $V_{DATA}$.

Figure 11:
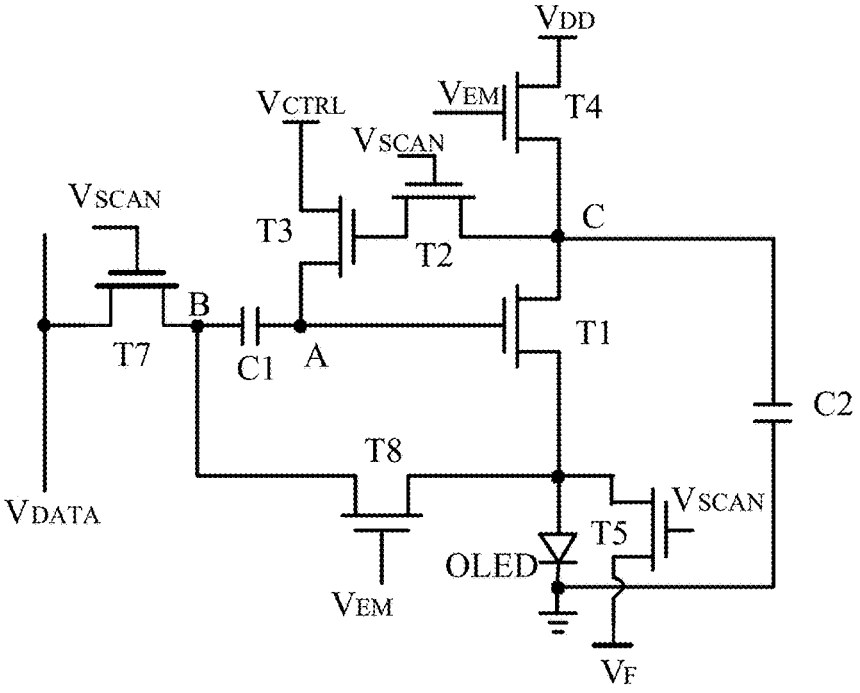
FIG. 11 is a structure diagram of improved pixel circuit in a third embodiment of the disclosure.

As a preferred embodiment, when OLED is connected in series between the second common electrode VSS and the first transistor T1, the bypass potential $V_F$ can also be introduced to the fifth transistor T5 as shown in FIG. 11. Specifically, the first electrode of the fifth transistor T5 is coupled to the first terminal of OLED, and the second electrode is used to receive bypass potential $V_F$, and the control electrode is used to receive the first scan control signal $V_{SCAN}$. The bypass potential $V_F$ is less than or equal to 0. In the case the bypass potential $V_F$ is negative, the longer the negative biasing time, the better OLED pixel circuit can compensate non-uniform brightness caused by the transient degradation of OLED.

The embodiment also discloses a display circuit driving method. The display circuit using the pixel circuit of the embodiment, and each of the driving cycles includes an initialization phase, a programming phase, and a emitting stage. The driving method includes:

In the initialization phase, the second transistor T2 and the third transistor T3 are turned on, the potential at two terminals of the first capacitor C1 are initialized; and the fourth transistor T4 and the seventh transistor T7 are turned on, the potential at two terminals of the second capacitor C2 are initialized.

In the programming phase, the second transistor T2, the third transistor T3 and the seventh transistor T7 are turned on. Thus threshold voltage of the first transistor T1 or threshold voltage of the first transistor T1 and OLED are transferred to the first node A by the second transistor T2 and the third transistor T3. And these threshold voltage will be stored in the first node A through the first capacitor C1. The data signal $V_{DATA}$ is stored in the second node B through the first capacitor C1.

In the emitting phase, the fourth transistor T4 is turned on, thus the emitting branch can be turned on. So the first transistor T1 is provided with a supply voltage, and the first transistor T1 generates a driving current to drive OLED to emit light.

The above content is combined with the specific implementation method of the disclosure for further discussions, and this disclosure is not limited to the above mentioned implementations. For the general technical personnel associated in the technical field, a number of simple deduction or replacement can be made under the premise of not being divorced from the idea of the disclosure. For example, the N channel transistor can be replaced by a P channel type transistor, and each input control signal level can be adjusted accordingly.

Fourth Embodiment

Figure 12:
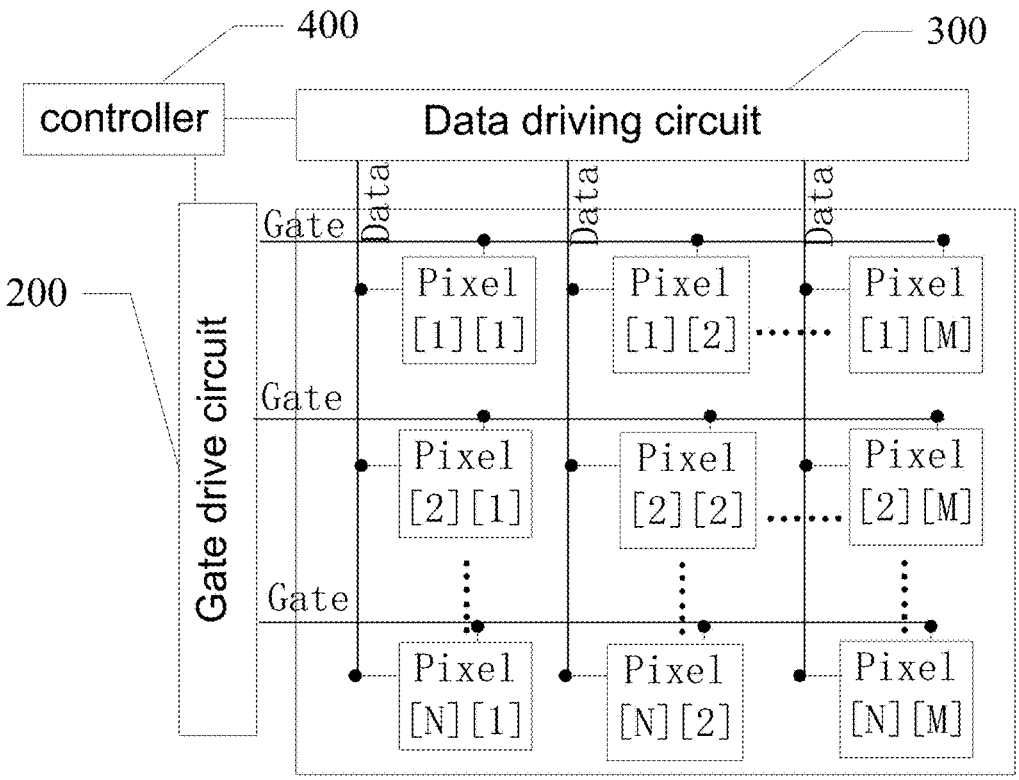
FIG. 12 is a structure diagram of a disclosed display device in a fourth embodiment of the disclosure.

As shown in FIG. 12, a display device of the present embodiment is disclosed, and the device includes a display panel 100. The display panel 100 comprises a two-dimensional pixel array which is composed of a plurality of two-dimensional pixels in the form of a n*m (that is, n rows and m columns, where m and n are positive integers) matrix, and a plurality of scan lines connected to each pixel in a first direction (for example a transverse direction), and $V_{SCAN}$ for providing a first scan control signal of each pixel, and a number of data lines in the second direction (for example longitudinal), and $V_{DATA}$ for providing a data signal to each pixel circuit. The pixels of same row in the pixel array are connected to the same scan line, and the pixels of same column in the pixel array are connected to the same data line. Each pixel of the display panel 100 adopts a pixel driving circuit provided by the above embodiment. Display panel 100 can be an organic emitting display panel, AMLCD, electronic paper display panel, etc. and the corresponding display device can be an organic emitting display, an electronic paper display device, etc.

Gate drive circuit 200, the gate scan signal output terminal of the gate drive unit circuit in the gate drive circuit 200 is coupled to the gate scan lines corresponding to output terminal in the display panel 100, so the first scan control signal $V_{SCAN}$ required by the pixel circuit is generated, the pixel array is scanned row by row; and the second scan control signal $V_{EM}$ and the third control signal $V_{CTRL}$ are provided to each pixel circuit row by row. The gate driving circuit 200 can be connected to the display panel 100 by welding or is integrated in the display panel 100.

Data driving circuit 300, the signal output terminal of the data driving circuit 300 is coupled to the data line Data which is corresponding to the signal output terminal in the display panel 100. The data signal VDATA generated by the data driving circuit 300 is transmitted to the corresponding pixel unit through the data line Data to realize the image gray level. The data driving circuit 300 can be connected to the display panel 100 by welding or is integrated in the display panel 100.

The controller 400, the controller 400 is used to provide the control timing for the gate drive circuit and the data drive circuit.

The above through the specific embodiment to describe the present disclosure, and the specific embodiment is only used to help understand the disclosure and not to limit the disclosure. For the general technical personnel in this field may change the specific implementation method according to the idea of the present disclosure.

We claim:

1. A pixel circuit, comprising:

a first capacitor, a second capacitor, a second transistor, a third transistor, and a emitting branch between a first common electrode and a second common electrode;

wherein:

the emitting branch comprises a first transistor, a fourth transistor and a emitting element in series;

a first electrode of the first transistor is coupled to a second electrode of the fourth transistor at a third node;

a control electrode of the fourth transistor is used to receive a second scan control signal;

the emitting branch is turned on or off by the fourth transistor corresponding to the second scan control signal;

a first terminal of the first capacitor is a second node, which is coupled to the data signal line and used for inputting of a data signal, and a second terminal of the first capacitor is coupled to a control electrode of the first transistor to form a first node;

one terminal of the second capacitor is directly coupled to the third node, and the other terminal is directly coupled to the second common electrode;

a control electrode of the second transistor is used to receive a first scan control signal, a first electrode is directly coupled to a control electrode of the third transistor, and a second electrode is directly coupled to the third node;

a first electrode of the third transistor is used to receive a third control signal, and a second electrode is directly coupled to the first node;

in a programming phase:

the fourth transistor is turned off corresponding to the second scan control signal;

the second transistor is turned on, corresponding to the first scan control signal, causing the third transistor to turn on;

the third control signal is supplied to the first node through the third transistor; and the data signal and a threshold voltage of the first transistor are stored in the first capacitor; and in an emitting phase:

the second transistor and the third transistor are turned off corresponding to the first scan control signal;

the fourth transistor is turned on corresponding to the second scan control signal; and a voltage of the first node controls the first transistor to provide a driving current to the emitting element.

2. The pixel circuit of claim 1, wherein a first electrode of the fourth transistor is coupled to the first common electrode, a first terminal of the emitting element is coupled to a second electrode of the first transistor, and a second terminal of the emitting element is coupled to the second common electrode.

3. The pixel circuit of claim 1, wherein a second electrode of the first transistor is coupled to the second common electrode, a first electrode of the fourth transistor is coupled to a second terminal of the emitting element, and a first terminal of the emitting element is coupled to the first common electrode.

4. The pixel circuit of claim 2, further comprising a fifth transistor, wherein a first electrode and a second electrode of the fifth transistor are connected in parallel with two terminals of the emitting element, and a control electrode is used to receive the first scan control signal.

5. The pixel circuit of claim 2, further comprising a fifth transistor, wherein a first electrode of the fifth transistor is coupled to the first terminal of the emitting element, a second electrode is used to receive a bypass potential, and a control electrode is used to receive the first scan control signal.

6. The pixel circuit of claim 5, wherein the bypass potential is less than or equal to 0.

7. The pixel circuit of claim 2, further comprising a fifth transistor, wherein a first electrode and second electrode of the fifth transistor are connected in parallel with two terminals of the emitting element, and a control electrode is used to receive the first scan control signal.

8. The pixel circuit of claim 1, wherein a seventh transistor is coupled between the second node and the data signal line, and an eighth transistor is coupled between the first capacitor and the first transistor;

a first electrode of the seventh transistor is coupled to the data signal line, a second electrode is coupled to the first terminal of the first capacitor, and a control electrode is used to receive the first scan control signal; and a first electrode of the eighth transistor is coupled to a second electrode of the seventh transistor, a second electrode of eighth transistor is coupled to a second electrode of the first transistor, and a control electrode of the eighth transistor is used to receive the second scanning control signal.

9. A display device, comprising:

a pixel circuit matrix which comprises pixel circuits of claim 1 arranged in rows of M and columns of N, wherein N and M are the integer greater than 0;

a gate driving circuit which is used for generating a scanning pulse signal, providing a first scan control signal to the pixel circuit through row scan lines formed in a first direction, and providing a second and third scan control signal to each row of pixels circuit in the first direction;

a data driving circuit which is used for generating a data voltage signal which represents gray level, and providing data signals to the pixel circuit through data lines formed in a second direction; and a controller, which is used to provide a control timing to the gate driver circuit and the data driving circuit.

10. A driving method for driving pixel circuit of claim 1, wherein each driving cycle of the pixel circuit comprising initialization phase, programming phase and emitting phase, and the driving method comprising:

in the initialization phase, the second transistor, the third transistor and the fourth transistor are turned on to initialize voltage at both terminals of the first capacitor and the second capacitor, respectively;

in the programming phase, the second transistor and the third transistor are turned on, a threshold voltage of the first transistor or a threshold voltage of the first transistor and the emitting element are transferred to the first node by the second transistor through the third transistor and stored at the first node through the first capacitor, and the data signal is stored in the second node through the first capacitor; and in the emitting phase, a driving current is provided by the first transistor according to a voltage difference between two terminals of the first capacitor, wherein the driving current drives the emitting element to emit.

11. The pixel circuit of claim 3, further comprising a fifth transistor, wherein a first electrode and second electrode of the fifth transistor are connected in parallel with two terminals of the emitting element, and a control electrode is used to receive the first scan control signal.

* * * * *